US006343606B1

(12) United States Patent
Salzsieder

(10) Patent No.: US 6,343,606 B1
(45) Date of Patent: Feb. 5, 2002

(54) METHOD OF PRODUCING WEAR RESISTANT SYNTHETIC HAIR

(76) Inventor: Klaus D. Salzsieder, No. 23 Daffodil Street, Pilar Village, Las Pinas City (PH)

( * ) Notice: Subject to any disclaimer, the term of this patent is extended or adjusted under 35 U.S.C. 154(b) by 1 days.

(21) Appl. No.: 09/620,135

(22) Filed: Jul. 20, 2000

(51) Int. Cl.[7] ..... A41G 3/00; A41G 5/00
(52) U.S. Cl. ..... 132/201; 132/53; 132/56
(58) Field of Search ..... 132/201, 54, 55, 132/56, 53

(56) References Cited

U.S. PATENT DOCUMENTS 3,485,249 A 12/1969 Mast
3,750,682 A * 8/1973 Bonafiglia ..... 132/53
3,786,822 A * 1/1974 Kimura et al. ..... 132/53
3,848,612 A 11/1974 Kohler
4,955,400 A * 9/1990 Takahashi ..... 132/56

* cited by examiner

*Primary Examiner*—Todd E. Manahan
(74) *Attorney, Agent, or Firm*—Nixon & Vanderhye

(57) ABSTRACT

An advantageous method for producing a wear resistant synthetic hair comprises mixing a monofilament nylon 6 mat having a diameter of about 0.09 mm with about 0.55 by weight titanium dioxide, and about 0.37% by weight calcium carbide, and heating the composition to a temperature of about 150° C. A toupee made from this synthetic hair has about 49–57 denier, a strength of about 6–8 grams per denier, an elongation of about 35–48%, and almost zero percent shrinkage.

17 Claims, No Drawings

METHOD OF PRODUCING WEAR RESISTANT SYNTHETIC HAIR

BACKGROUND AND SUMMARY OF THE INVENTION

The present invention generally relates to a method of producing a filamentous structure and more particularly to a synthetic hair having characteristics that resemble natural hair.

In the early years, synthetic hair (e.g. see U.S. Pat. Nos. 3,848,612 and 3,485,249, the disclosures of which are incorporated by reference herein) began to receive serious consideration as an alternative to cover bald spots. Conventional synthetic hair is primarily based on dyed nylon or silk. However, these conventional synthetic hairs tend to have poor wear resistance when exposed to environmental conditions. The term "wear resistance" means the degree of resistance of dye detachment from the nylon or silk surface when it is exposed to environmental conditions. It has been found that a substantial portion of conventional synthetic hairs tend to wear away in less than a few months after exposure to environmental conditions. The method of the present invention solves this problem by improving the wear resistance of synthetic hair.

One of the advantages of the method of the present invention is its fast dyed characteristic even under high humidity conditions.

Still another advantage of the present method is the long life stability of the synthetic hair composition used therein.

The present invention is directed to a method for producing synthetic hair useful in making toupees comprising:

Mixing monofilament nylon 6 mat having a diameter of about 0.08–0.1 mm, preferably about 0.09 mm, with about 0.2–0.8%, preferably about 0.5%, by weight of the nylon, titanium dioxide, and about 0.25–0.5%, preferably about 0.37%, by weight of the nylon, calcium carbide to form a composition; and Heating the composition to a temperature of about 140–160° C. (e.g. about 150° C.). The mixing may actually take place at a temperature over 100° C., preferably about 150° C., with or without dye.

If desired, the synthetic hair composition in the method of the present invention may further include dyeing with different colors, including all colors of natural human hair, and other additives also may be utilized.

The synthetic hair produced according to the invention is useful in making a toupee having about 49–57 denier, a strength of about 6–8 gm/Denier, an elongation of about 35–48%, and almost zero percent shrinkage.

From the description above, it can be seen that applicant has made an unexpected discovery that the presence of titanium dioxide and calcium carbide in a synthetic hair composition significantly improves the life and properties of the synthetic hair produced.

It is the primary object of the present invention to provide a relatively simple yet highly effective method for the production of synthetic hair. This and other objects of the invention will become clear from an inspection of the detailed description of the invention and from the appended claims.

DETAILED DESCRIPTION

According to one aspect of the present invention there is provided a method for producing wear resistant synthetic hair comprising: (a) Mixing a monofilament nylon 6 mat having a diameter of between about 0.08–0.1 millimeters, with about 0.2–0.8%, by weight of the nylon, titanium dioxide, and about 0.25–0.5%, by weight of the nylon, calcium carbide, to form a composition. And, (b) heating the composition to a temperature of about 140–160° C., to produce wear resistant synthetic hair. The method may further comprise (c) contacting the synthetic hair with a dye to provide a substantially natural human hair color. In the method (a) may be practiced by using a monofilament nylon 6 mat having a diameter of about 0.09 millimeters; and by using about 0.5% by weight titanium dioxide, and about 0.37% by weight calcium carbide; and (b) is preferably practiced at about 150° C.

The method preferably comprises the further step (d) of making a toupee for use by a human, for example on his or her head, chest, or other body part, using conventional techniques used for creating toupees using synthetic hair. The method preferably also comprises (e) fitting the toupee on a human's head or body.

According to the present invention there also is provided a toupee made pursuant to any of the particular procedures described above. The toupee according to the invention preferably has about 49–57 denier, a strength of about 6–8 grams per denier, an elongation of about 35–48%, and almost zero percent shrinkage.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for producing wear resistant synthetic hair comprising:

(a) mixing a monofilament nylon 6 mat having a diameter of between about 0.08–0.1 millimeters, with about 0.2–0.8%, by weight of the nylon, titanium dioxide, and about 0.25–0.5%, by weight of the nylon, calcium carbide, to form a composition; and (b) heating said composition to a temperature of about 140–160° C., to produce wear resistant synthetic hair.

2. A method as recited in claim 1 further comprising (c) contacting the synthetic hair with a dye to provide a substantially natural human hair color.

3. A method as recited in claim 2 further comprising (d) making the synthetic hair into a toupee.

4. A method as recited in claim 2 wherein (a) is practiced using a monofilament nylon 6 mat having a diameter of about 0.09 millimeters.

5. A method as recited in claim 4 wherein (a) is further practiced by using about 0.5% by weight titanium dioxide, and about 0.37% by weight calcium carbide.

6. A method as recited in claim 5 further comprising (d) making the synthetic hair into a toupee.

7. A method as recited in claim 6 further comprising (e) fitting the toupee on a human's head or body.

8. A toupee made according to the method recited in claim 6.

9. A toupee as recited in claim 8 having about 49–57 denier, a strength of about 6–8 grams per denier, an elongation of about 35–48%, and almost zero percent shrinkage.

10. A method as recited in claim 1 wherein (a) is practiced using a monofilament nylon 6 mat having a diameter of about 0.09 millimeters.

11. A method as recited in claim 1 wherein (a) is further practiced by using about 0.5% by weight titanium dioxide, and about 0.37% by weight calcium carbide.

12. A method as recited in claim 1 further comprising (d) making the synthetic hair into a toupee.

13. A method as recited in claim 12 further comprising (e) fitting the toupee on a human's head or body.

14. A method as recited in claim 12 wherein (a) is practiced in an environment having a temperature of about 150° C.

15. A toupee made according to the method recited in claim 12.

16. A toupee as recited in claim 15 having about 49–57 denier, a strength of about 6–8 grams per denier, an elongation of about 35–48%, and almost zero percent shrinkage.

17. A method as recited in claim 1 wherein (a) is practiced in an environment having a temperature of about 150° C.

* * * * *